US009578407B2

(12) United States Patent
Fujioka

(10) Patent No.: US 9,578,407 B2
(45) Date of Patent: Feb. 21, 2017

(54) MULTI-MODE AUDIO DEVICE AND MONITORING SYSTEM

(71) Applicant: Mattel, Inc., El Segundo, CA (US)

(72) Inventor: Robb Fujioka, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 222 days.

(21) Appl. No.: 13/834,986

(22) Filed: Mar. 15, 2013

(65) Prior Publication Data

US 2014/0153735 A1 Jun. 5, 2014

Related U.S. Application Data

(60) Provisional application No. 61/732,207, filed on Nov. 30, 2012.

(51) Int. Cl.

| | |
|---|---|
| ***H04R 1/10*** | (2006.01) |
| ***H04R 29/00*** | (2006.01) |
| *H04R 3/00* | (2006.01) |

(52) U.S. Cl.

CPC ..... *H04R 1/1041* (2013.01); *H04R 29/001* (2013.01); *H04R 3/007* (2013.01); *H04R 2205/041* (2013.01); *H04R 2420/07* (2013.01); *H04R 2430/01* (2013.01)

(58) Field of Classification Search

CPC ..... H04R 2430/01; H04R 1/1041; H04R 2225/61; H04R 3/00; H04R 5/04; H04R 5/033; H04R 29/00; H04R 2420/03

USPC ..... 381/56–60, 320–321, 74, 101–102, 381/104–109, 370; 455/233.1, 355, 323.1, 455/177.1

See application file for complete search history.

(56) References Cited

U.S. PATENT DOCUMENTS

| | | | | |
|---|---|---|---|---|
| 2003/0002688 | A1* | 1/2003 | Kanevsky | H04R 3/00 381/74 |
| 2007/0047740 | A1* | 3/2007 | Andrea | H04R 1/1041 381/74 |
| 2007/0230715 | A1* | 10/2007 | Ingemi | H03G 11/02 381/74 |
| 2012/0057726 | A1* | 3/2012 | van Wijngaarden | H03G 7/002 381/107 |
| 2013/0202121 | A1* | 8/2013 | Georgiou | H03G 9/005 381/56 |

* cited by examiner

*Primary Examiner* — Md S Elahee
*Assistant Examiner* — Sabrina Diaz
(74) *Attorney, Agent, or Firm* — Kolisch Hartwell, P.C.

(57) ABSTRACT

A multi-mode audio device includes speakers and a sound output control configured to control a maximum level of sound emitted by the speakers. The sound output control comprises a control interface configured to receive selection of an operative mode of the multi-mode audio device from among a managed mode and a normal mode. An access control communicatively coupled to the sound output control is configured to require an authentication to switch from the managed mode to the normal mode. A mode indicator communicatively coupled to the sound output control and configured to provide a visual indication of the operative mode. Optionally, a monitoring system communicatively coupled to the sound output control is configured to capture one or more data regarding usage of the multi-mode audio device and to generate a report regarding the one or more data regarding usage of the multi-mode audio device.

19 Claims, 3 Drawing Sheets

MULTI-MODE AUDIO DEVICE AND MONITORING SYSTEM

CROSS-REFERENCE TO RELATED APPLICATIONS

This application claims the benefit of U.S. Provisional Application Ser. No. 61/732,207, entitled "Multi-Mode Audio Device," filed Nov. 30, 2012, the entirety of which is hereby incorporated herein by this reference as if fully set forth herein.

FIELD OF THE INVENTION

The present invention relates to the field of audio devices and, more particularly, but not by way of limitation, to providing, monitoring, and controlling multiple modes of operation in a portable audio device.

BACKGROUND OF THE INVENTION

Portable electronic audio emission devices, such as headphones, comprise a pair of small speakers designed to be in close proximity to a user's ears that are plugged into an audio source such as an amplifier, portable media player, mobile phone or PC/tablet computer. Today, common types of headphones are over-the-ear headphones and earbuds. Over-the-ear headphones have ear cups that encompass and surround the entire ear, whereas earbuds fit directly into the user's outer ear. As used herein, the term headphones is intended to encompass, without limitation, over-the-ear headphones and earbuds as described above, as well as other audio sources, such as portable speakers.

Headphones marketed for children may be smaller versions of their adult counterpart. Often, they are more toy-like in feel and appearance, or marketed and sold based on a specific licensed property (e.g., StarWars, Hello Kitty, Batman, etc.). The drawbacks of such headphones may include, without limitation, low quality in construction and sound fidelity and/or higher-prices to cover licensing fees for use of the licensed property.

Headphones for children may also include mechanisms to protect a child's ears from harmful decibel or sound levels. In addition, some parents may desire to limit sound levels in their children's headphones even more than may be required for safety out of abundant caution and/or to reduce sound emitted outside the headphones in environments where quiet is desired, such as when other children may be sleeping or consuming media of their own.

BRIEF SUMMARY OF PREFERRED EMBODIMENTS OF THE INVENTION

A multi-mode audio device includes speakers and a sound output control configured to control a maximum level of sound emitted by the speakers. The sound output control comprises a control interface configured to receive selection of an operative mode of the multi-mode audio device from among a managed mode and a normal mode. An access control communicatively coupled to the sound output control is configured to require an authentication to switch from the managed mode to the normal mode. A mode indicator communicatively coupled to the sound output control and configured to provide a visual indication of the operative mode. Optionally, a monitoring system communicatively coupled to the sound output control is configured to capture one or more data regarding usage of the multi-mode audio device and to generate a report regarding the one or more data regarding usage of the multi-mode audio device.

In some embodiments, the managed mode may include more than one managed mode, such as may be beneficial for multiple managed mode users and/or as may be appropriate for the space in which the audio device is to be used.

In some embodiments, the control interface is a physical switch. In other embodiments, the control interface is a touch screen display.

In some embodiments, the mode indicator indicates provides a visual indication that the audio device is in a managed mode by displaying one or more of a light, a color, and a pattern of lights associated with the managed mode when the operative mode is the managed mode. The mode indicator may display a different light, color, and/or pattern of lights associated with the normal mode when the operative mode is the normal mode. Alternatively, the mode indicator may switch off when the operative mode is the normal mode.

In managed mode, the sound output control limits the maximum level of sound emitted by the one or more speakers to a level predetermined to be a safe maximum level. This may be an objective measure, such as but not limited to, 80 dB. Alternatively, this may be a level determined by a user based on the user's own preferences and/or the setting in which the audio device is to be used.

The audio device may also include a wireless communication interface communicatively coupled to the sound output control that is configured to receive via a wireless network a selection of the operative mode from a computer. In some embodiments, the wireless communication interface is configured to receive from a computer via a wireless network a selection of the operative mode and to transmit to the computer via the wireless network the report regarding the one or more data regarding usage of the multi-mode audio device.

In some embodiments, the managed mode comprises an assistive mode configured to adapt the maximum level of sound emitted by the one or more speakers to a level appropriate for a person with hearing loss.

Various embodiments may incorporate one or more of these and other features described herein while remaining within the spirit and scope of the invention. Further features of the multi-mode audio device, its nature, and various advantages and embodiments will be more apparent by reference to the accompanying drawings and the following detailed description.

BRIEF DESCRIPTION OF THE DRAWINGS

Preferred embodiments of the present invention are illustrated by way of example, and not by way of limitation, in the figures of the accompanying drawings and in which like reference numerals refer to similar elements and in which.

DETAILED DESCRIPTION OF PREFERRED EMBODIMENTS OF THE INVENTION

In the following description, numerous specific details have been set forth to provide a more thorough understanding of some embodiments of the present invention. However, it will be appreciated by those skilled in the art that embodiments of the invention may be practiced without such specific details or with different implementations for such details. Additionally some well known structures have not been shown in detail to avoid unnecessarily obscuring the present invention.

Figure 1:
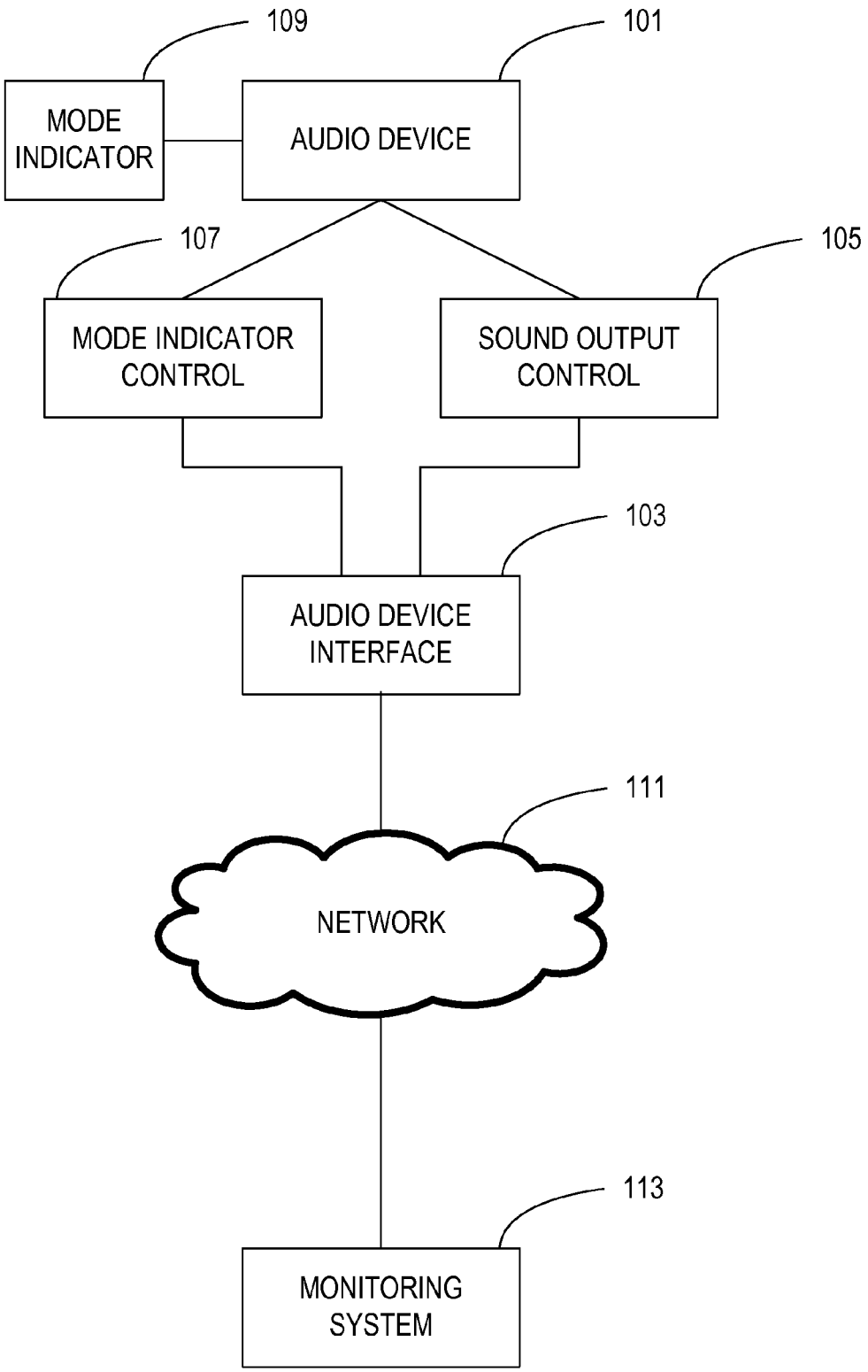
FIG. 1 is a block diagram illustrating an exemplary configuration for a multi-mode device and monitoring system, according to some embodiments.

FIG. 1 is a block diagram illustrating an exemplary configuration for a multi-mode device and monitoring system according to some embodiments. In some embodiments, audio device 101, which may include high-quality, over-the-ear headphones, is provided with multiple listening modes, such as a managed mode, and a normal mode. In some embodiments, switching or toggling between the modes may be accomplished by an audio device interface 103, which includes mechanical switch or electronic button or control on the headphone or via other controls discussed further below.

Sound output control 105 is configured to produce different sound output depending on the mode selected at audio device interface 103. In some embodiments of a managed mode, sound output control 105 limits sound volume to a level previously determined to be a safe decibel level, for example and without limitation, a decibel level of approximately 80 dB. In some embodiments, sound output control 105 amplifies sound volume or modulated sound output of audio device 101 for use by users with hearing impairment. Mode indicator control 107 controls the operation of mode indicator 109 on audio device 101. Mode indicator control 107 sends one or more signals which cause mode indicator 109 to illuminate or appear with a light, color, pattern, or other visual identification associated with a particular managed mode. For example, mode indicator 109 illuminates with white or other colored light and/or in one or more patterns of light on an externally visible area of the headphones when managed mode is active.

In some embodiments of a normal mode, sound output control 105 configures the headphones to have a normal sound volume based on the maximum dB output of the audio source. In normal mode, mode indicator control 107 sends one or more signals which cause mode indicator 109 to illuminate or appear with a light, pattern, or other visual identification associated with normal mode that is different from the light for managed mode. For example, mode indicator 109 illuminates with red or other colored light and/or in one or more patterns of light on an externally visible area of the headphones when normal mode is active. Alternatively, in some embodiments, visual identification for normal mode includes no illumination by mode indicator 109. Some embodiments may provide a mechanism for switching off either or both of normal mode or managed mode lights without departing from the spirit of the invention. Illumination provides parents or others interested in monitoring use of the headphones to confirm visually whether the headphones are configured for listening at a safe audio level by looking at the illumination color or other mode identifier of mode indicator 109 reflecting the operative mode of the headphones.

Advantages of multiple listening modes include, without limitation, that the managed mode can be controlled or supervised by a supervisor, such as a parent, care provider for a child, or teacher of children.

Switching between the modes may be secured by access controls on audio device interface 103 such as by pass code, key, chip signal, or other security means, to prevent a user from overriding the managed mode.

While the above examples are described relative to headphones, embodiments of the multi-mode headphones described above may be implemented on various headphone designs, including over-the-ear headphones, earbuds, or loudspeakers not worn in proximity to the ears, or other audio emission device, without departing from the spirit or scope of the invention.

In some embodiments, the headphones are communicatively coupled, such as via a communication interface, through network 111 to a monitoring system 113 which provides the ability to monitor and control the headphones. In some embodiments, the interface for the monitoring system is connected wirelessly (e.g., by wireless LAN, Bluetooth) or by cable (e.g., by USB, etc.) connected to the headphones, such as on a desktop PC, a hand-held computer, a car stereo interface, or via a Web-based interface. In some embodiments, the interface for monitoring system 113 is provided on the headphone device.

Figure 2:
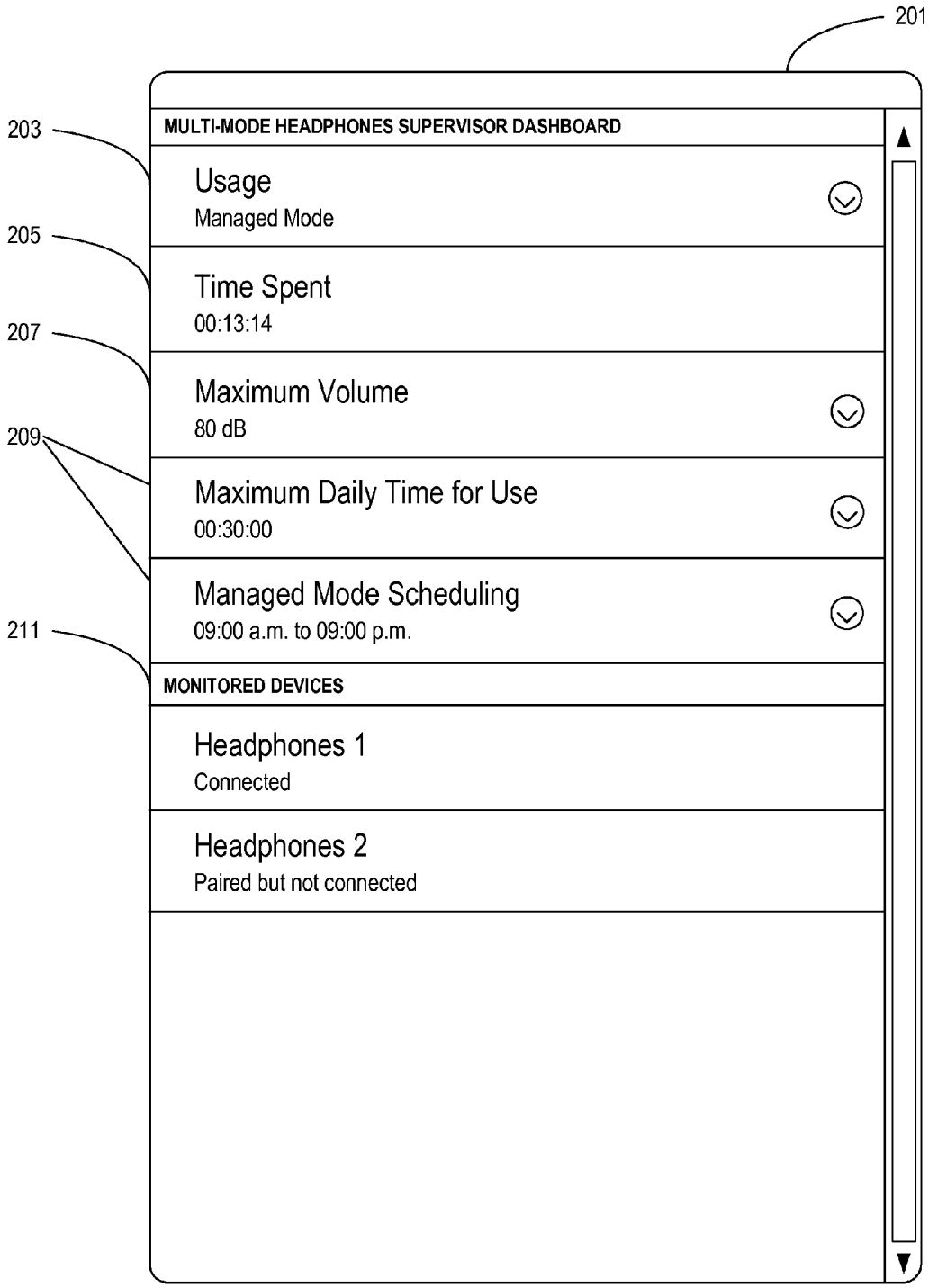
FIG. 2 is a diagram illustrating one example of an interface for a monitoring system, according to some embodiments.

FIG. 2 is a diagram illustrating one example of an interface for monitoring system 113, according to some embodiments. Monitoring system interface 201 comprises a "supervisor dashboard" application that may monitor characteristics such as mode usage 203, time elapsed for mode usage 205, and can also control the connected headphones to control the volume profile, for example, maximum output volume 207, or other volume profile for particular frequencies for the hearing impaired, or time controls 209 for controlling a schedule of when the headphones could be active and usable in a particular operational mode, including normal or managed modes. In some embodiments, the monitoring system may run on a networked computer, such as a server on a wireless WAN, for example, as web-based application, or on a Bluetooth connection or a wireless LAN, such as from a hand-held device from a home network. FIG. 2 further includes a monitored devices 211 area for controlling and showing which audio device is communicatively connected to the monitoring system.

In some embodiments, while the headphones are connected to the a wireless LAN, the web-based application may control and monitor the headphones from a WAN source, for example, if network 111 is a cellular data network.

Figure 3:
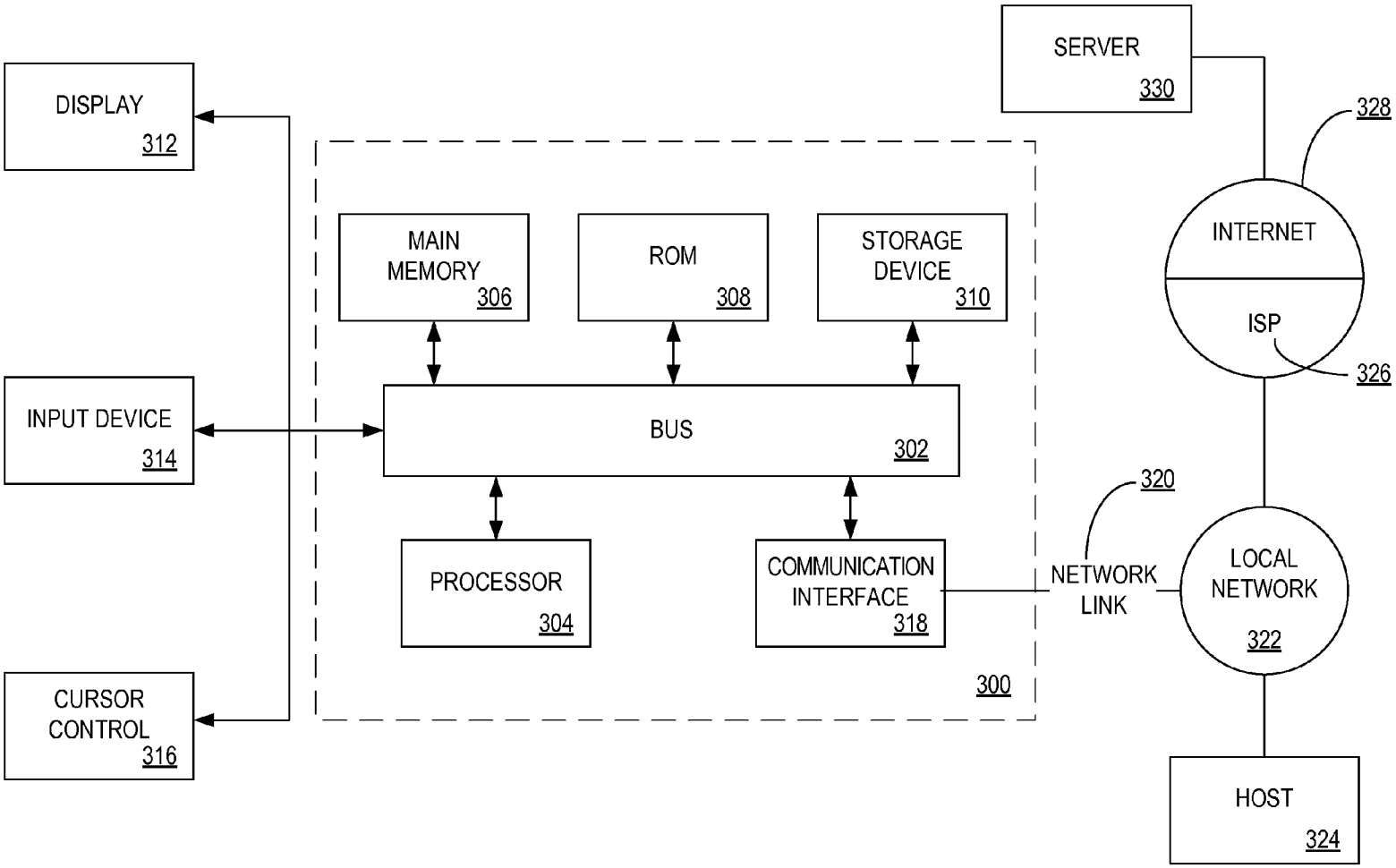
FIG. 3 is a block diagram that illustrates a computer system upon which some embodiments may be implemented.

FIG. 3 is a block diagram that illustrates a computer system 300 upon which some embodiments may be implemented. Computer system 300 includes a bus 302 or other communication mechanism for communicating information, and a processor 304 coupled with bus 302 for processing information. Computer system 300 also includes a main memory 306, such as a random access memory (RAM) or other dynamic storage device, coupled to bus 302 for storing information and instructions to be executed by processor 304. Main memory 306 also may be used for storing temporary variables or other intermediate information during execution of instructions to be executed by processor 304. Computer system 300 further includes a read only memory (ROM) 308 or other static storage device coupled to bus 302 for storing static information and instructions for processor 304. A storage device 310, such as a magnetic disk, optical disk, or a flash memory device, is provided and coupled to bus 302 for storing information and instructions.

Computer system 300 may be coupled via bus 302 to a display 312, such as a cathode ray tube (CRT) or liquid crystal display (LCD) or other display device, for displaying information to a computer user. An input device 314, including alphanumeric and other keys, is coupled to bus 302 for communicating information and command selections to processor 304. Another type of user input device is cursor control 316, such as a mouse, a trackball, or cursor direction keys for communicating direction information and command selections to processor 304 and for controlling cursor movement on display 312. This input device typically has two degrees of freedom in two axes, a first axis (e.g., x) and a second axis (e.g., y), that allows the device to specify positions in a plane. In some embodiments, input device 314 is integrated into display 312, such as a touchscreen display for communication command selection to processor 304. Another type of input device includes a video camera, a depth camera, or a 3D camera. Another type of input device includes a voice command input device, such as a microphone operatively coupled to speech interpretation module for communication command selection to processor 304.

Some embodiments are related to the use of computer system 300 for implementing the techniques described herein. According to some embodiments, those techniques are performed by computer system 300 in response to processor 304 executing one or more sequences of one or more instructions contained in main memory 306. Such instructions may be read into main memory 306 from another machine-readable medium, such as storage device 310. Execution of the sequences of instructions contained in main memory 306 causes processor 304 to perform the process steps described herein. In alternative embodiments, hard-wired circuitry may be used in place of or in combination with software instructions to implement the invention. Thus, embodiments are not limited to any specific combination of hardware circuitry and software. In further embodiments, multiple computer systems 300 are operatively coupled to implement the embodiments in a distributed system.

The terms "machine-readable medium" as used herein refer to any medium that participates in providing data that causes a machine to operate in a specific fashion. In an embodiment implemented using computer system 300, various machine-readable media are involved, for example, in providing instructions to processor 304 for execution. Such a medium may take many forms, including but not limited to storage media and transmission media. Storage media includes both non-volatile media and volatile media. Non-volatile media includes, for example, optical disks, magnetic disks, or flash memory devices, such as storage device 310. Volatile media includes dynamic memory, such as main memory 306. Transmission media includes coaxial cables, copper wire and fiber optics, including the wires that comprise bus 302. Transmission media can also take the form of acoustic or light waves, such as those generated during radio-wave and infra-red data communications. All such media must be tangible to enable the instructions carried by the media to be detected by a physical mechanism that reads the instructions into a machine.

Common forms of machine-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, flash memory device, any other memory chip or cartridge, a carrier wave as described hereinafter, or any other medium from which a computer can read.

Various forms of machine-readable media may be involved in carrying one or more sequences of one or more instructions to processor 304 for execution. For example, the instructions may initially be carried on a magnetic disk of a remote computer. The remote computer can load the instructions into its dynamic memory and send the instructions over a data transmission line using a modem. A modem local to computer system 300 can receive the data on the data transmission line and use an infra-red transmitter to convert the data to an infra-red signal. An infra-red detector can receive the data carried in the infra-red signal and appropriate circuitry can place the data on bus 302. Bus 302 carries the data to main memory 306, from which processor 304 retrieves and executes the instructions. The instructions received by main memory 306 may optionally be stored on storage device 310 either before or after execution by processor 304.

Computer system 300 also includes a communication interface 318 coupled to bus 302. Communication interface 318 provides a two-way data communication coupling to a network link 320 that is connected to a local network 322. For example, communication interface 318 may be an integrated services digital network (ISDN) card or other internet connection device, or a modem to provide a data communication connection to a corresponding type of data transmission line. As another example, communication interface 318 may be a local area network (LAN) card to provide a data communication connection to a compatible LAN. Wireless network links may also be implemented. In any such implementation, communication interface 318 sends and receives electrical, electromagnetic or optical signals that carry digital data streams representing various types of information.

Network link 320 typically provides data communication through one or more networks to other data devices. For example, network link 320 may provide a connection through local network 322 to a host computer 324 or to data equipment operated by an Internet Service Provider (ISP) 326. ISP 326 in turn provides data communication services through the world wide packet data communication network now commonly referred to as the Internet 328. Local network 322 and Internet 328 both use electrical, electromagnetic or optical signals that carry digital data streams. The signals through the various networks and the signals on network link 320 and through communication interface 318, which carry the digital data to and from computer system 300, are exemplary forms of carrier waves transporting the information.

Computer system 300 can send messages and receive data, including program code, through the network(s), network link 320 and communication interface 318. In the Internet example, a server 330 might transmit a requested code for an application program through Internet 328, ISP 326, local network 322 and communication interface 318.

The received code may be executed by processor 304 as it is received, and/or stored in storage device 310, or other non-volatile storage for later execution. In this manner, computer system 300 may obtain application code in the form of a carrier wave.

Other features, aspects and objects of the invention can be obtained from a review of the figures and the claims. It is to be understood that other embodiments of the invention can be developed and fall within the spirit and scope of the invention and claims.

The foregoing description of preferred embodiments of the present invention has been provided for the purposes of illustration and description. It is not intended to be exhaustive or to limit the invention to the precise forms disclosed. Various additions, deletions and modifications are contemplated as being within its scope. The scope of the invention is, therefore, indicated by the appended claims rather than the foregoing description. Further, all changes which may fall within the meaning and range of equivalency of the claims and elements and features thereof are to be embraced within their scope.

What is claimed is:

1. A multi-mode audio device, comprising:

a headphone body;

one or more speakers attached to the headphone body, the one or more speakers configured to emit sound responsive to an audio signal input;

a sound output control on the headphone body and communicatively coupled to the one or more speakers and configured to control a maximum level of sound emitted by the one or more speakers, the sound output control having:

a control interface configured to receive selection of an operative mode of the multi-mode audio device from among a managed mode and a normal mode, wherein if the operative mode is set to managed mode, then the sound output control limits the maximum level of sound emitted by the one or more speakers to a level predetermined to be a safe maximum level, and if the operative mode is set to normal mode, then the sound output control configures the one or more speakers to emit sound based on a maximum dB output limit of the audio source; and an access control that is communicatively coupled to the sound output control and requires an authentication to switch from the managed mode to the normal mode;

an electronic button attached to the headphone body that when activated switches from the managed mode to the normal mode if the authentication is received by the control interface;

a mode indicator communicatively coupled to the sound output control and configured to provide a visual indication of the operative mode; and a monitoring system interface that monitors mode usage of the managed mode and the normal mode.

2. The multi-mode audio device of claim 1, further comprising: a monitoring system communicatively coupled to the sound output control and configured to capture one or more data regarding usage of the multi-mode audio device and to generate a report regarding the one or more data regarding usage of the multi-mode audio device.

3. The multi-mode audio device of claim 1, wherein the managed mode comprises more than one managed mode.

4. The multi-mode audio device of claim 1, wherein the control interface comprises a physical switch.

5. The multi-mode audio device of claim 1, wherein the control interface comprises a touch screen display.

6. The multi-mode audio device of claim 1, wherein the mode indicator is configured to display one or more of a light, a color, and a pattern of lights associated with the managed mode when the operative mode is the managed mode.

7. The multi-mode audio device of claim 1, wherein the mode indicator is configured to display one or more of a light, a color, and a pattern of lights visually distinct from the one or more of the light, the color, and the pattern of lights associated with the managed mode when the operative mode is the normal mode.

8. The multi-mode audio device of claim 1, wherein the mode indicator is configured to switch off when the operative mode is the normal mode.

9. The multi-mode audio device of claim 1, wherein the level predetermined to be a safe maximum level is approximately 80 dB.

10. The multi-mode audio device of claim 1, wherein the level predetermined to be a safe maximum level is a level set by a user via the control interface.

11. The multi-mode audio device of claim 1, further comprising a wireless communication interface communicatively coupled to the sound output control and configured to receive via a wireless network a selection of the operative mode from a computer.

12. The multi-mode audio device of claim 2, further comprising a wireless communication interface communicatively coupled to the sound output control and the monitoring system, the wireless communication interface configured to receive from a computer via a wireless network a selection of the operative mode and to transmit to the computer via the wireless network the report regarding the one or more data regarding usage of the multi-mode audio device.

13. The multi-mode audio device of claim 1, wherein the managed mode comprises an assistive mode configured to adapt the maximum level of sound emitted by the one or more speakers to a level appropriate for a person with hearing loss.

14. An audio system comprising:

a headphone body;

one or more speakers attached to the headphone body, the one or more speakers emit sound responsive to an audio signal input;

a sound output control on the headphone body and coupled to the one or more speakers and control a maximum level of sound emitted by the one or more speakers, the sound output control having a control interface that receives selection of an operative mode of the audio system from among a managed mode and a normal mode, wherein if the operative mode is set to managed mode, then the sound output control limits the maximum level of sound emitted by the one or more speakers to a level predetermined to be a safe maximum level, and if the operative mode is set to normal mode, then the sound output control configures the one or more speakers to emit sound based on a maximum dB output limit of the audio source;

an access control that is communicatively coupled to the sound output control and requires an authentication to switch from the managed mode to the normal mode; and a monitoring system coupled to the sound output control, wherein the monitoring system monitors and controls the sound output control to set a maximum daily time limit for use of the audio system, wherein the monitoring system is further coupled to an interface that monitors mode usage of the managed mode and the normal mode.

15. The system of claim 14, wherein the interface further monitors time elapsed for mode usage of the managed mode and the normal mode.

16. The system of claim 14, wherein the monitoring system controls the maximum output volume of the sound output control via the interface.

17. The system of claim 16, wherein the monitoring system further controls a volume profile for particular frequencies for the hearing impaired via the interface.

18. The system of claim 14, wherein the monitoring system further monitors and controls the sound output control to maintain a schedule of when the headphone is active and usable in normal or managed modes of operation.

19. The system of claim 14, wherein the headphone body is one of an over-the-ear headphone or an earbud.

* * * * *